US005590240A

United States Patent [19]

Rezabek

[11] Patent Number: 5,590,240

[45] Date of Patent: Dec. 31, 1996

[54] ULTRA PURE WATER HEATER WITH COAXIAL HELICAL FLOW PATHS

[75] Inventor: Dennis J. Rezabek, Thompson, Ohio

[73] Assignee: Process Technology Inc, Mentor, Ohio

[21] Appl. No.: 453,480

[22] Filed: May 30, 1995

[51] Int. Cl.[6] ..... F24H 1/16

[52] U.S. Cl. ..... 392/483; 165/184; 165/DIG. 441

[58] Field of Search ..... 392/481, 479, 392/480, 483, 470; 165/184, 156, DIG. 406, DIG. 440, DIG. 441; 338/296, 299, 302, 304

[56] References Cited

U.S. PATENT DOCUMENTS

| | | | |
|---|---|---|---|
| 534,699 | 2/1895 | Shaw | 338/304 |
| 1,376,485 | 5/1921 | Verstraete | 392/481 |
| 1,505,179 | 8/1924 | Whiteley . | |
| 1,631,753 | 6/1927 | Midulla | 392/481 |
| 1,759,774 | 5/1930 | Andriully . | |
| 1,893,484 | 1/1933 | Belt | 165/DIG. 406 |
| 2,021,509 | 11/1935 | Hastings | 338/299 |
| 2,809,268 | 10/1957 | Heron . | |
| 2,879,372 | 3/1959 | Dammond . | |
| 3,125,657 | 3/1964 | Colten . | |
| 3,870,033 | 3/1975 | Faylor et al. . | |
| 3,968,346 | 7/1976 | Cooksley . | |
| 3,983,361 | 9/1976 | Wild et al. . | |
| 4,179,603 | 12/1979 | Zeigler et al. . | |
| 4,371,777 | 2/1983 | Roller et al. . | |
| 4,461,347 | 7/1984 | Layton et al. . | |
| 4,668,855 | 5/1987 | Wilson et al. | 392/385 |
| 4,762,980 | 8/1988 | Insley . | |
| 4,835,365 | 5/1989 | Etheridge . | |
| 5,054,107 | 10/1991 | Batchelder | 392/483 |
| 5,054,108 | 10/1991 | Gustin et al. . | |
| 5,216,743 | 6/1993 | Seitz | 392/490 |
| 5,271,086 | 12/1993 | Kamiyama et al. | 392/483 |
| 5,396,574 | 3/1995 | Base et al. . | |

FOREIGN PATENT DOCUMENTS

| | | | |
|---|---|---|---|
| 161709 | 3/1955 | Australia . | |
| 261481 | 4/1960 | Australia . | |
| 236937 | 1/1962 | Australia . | |
| 570586 | 11/1993 | European Pat. Off. | 392/483 |
| 512357 | 1/1921 | France | 392/483 |
| 2853910 | 7/1980 | Germany . | |
| 3432717 | 3/1986 | Germany . | |
| 3-294740 | 12/1991 | Japan . | |
| 2224103 | 4/1990 | United Kingdom . | |

*Primary Examiner*—John A. Jeffery

[57] ABSTRACT

A high efficiency, non-contaminating fluid heater, including inner and outer helical passageways formed from an electrically non-conductive material and through which ultra pure fluid, such as ultra pure water, passes as it is heated. A coiled resistance heater is disposed about the helical outer surface of the inner helical passageway to heat by radiation, conduction and convection the ultra pure fluid which flows through the inner passageway. The outer passageway substantially surrounds the inner passageway and, at least in part, supports the outer passageway. The outer helical passageway is disposed to enable ultra pure fluid flowing therethrough to absorb radiated and convected heat from the coiled resistance heater to increase the efficiency of the fluid heater.

32 Claims, 4 Drawing Sheets

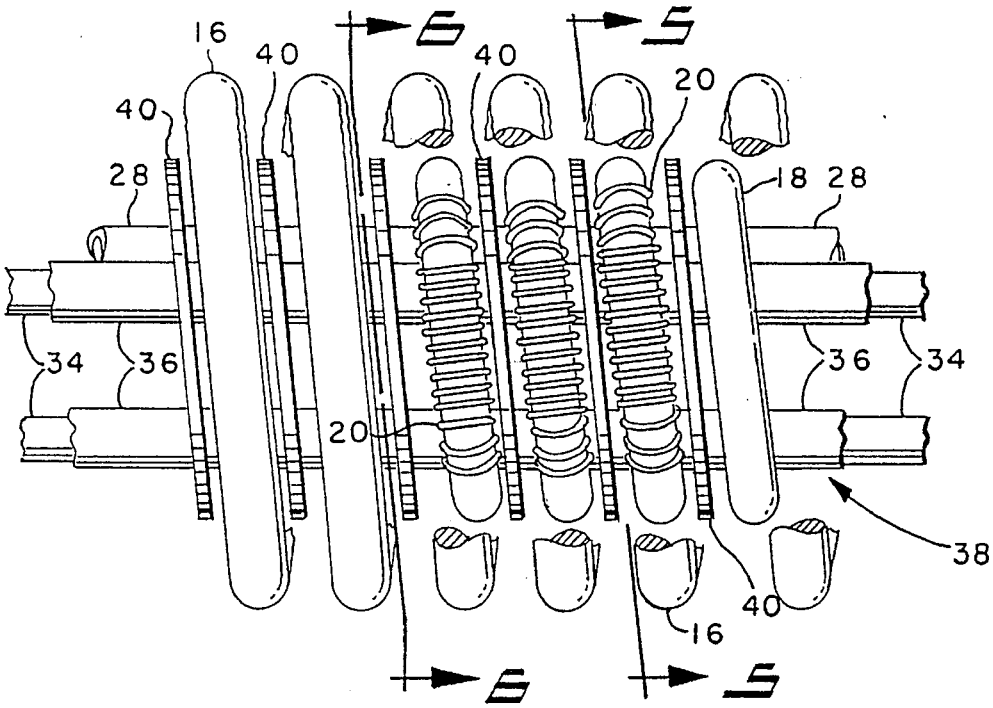
Fig. 4
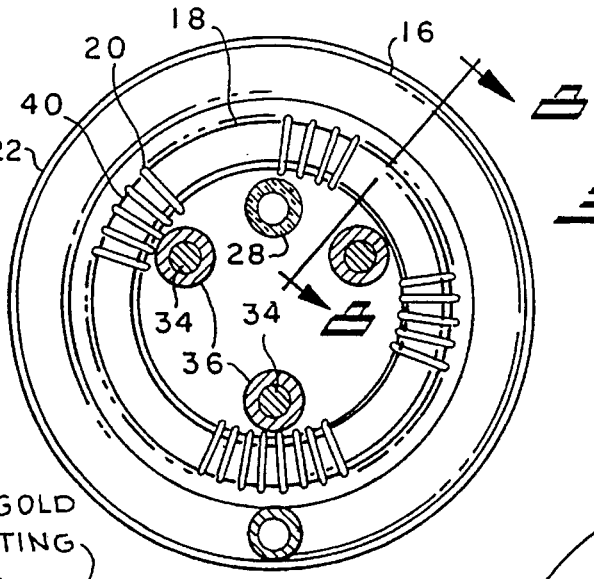
Fig. 5
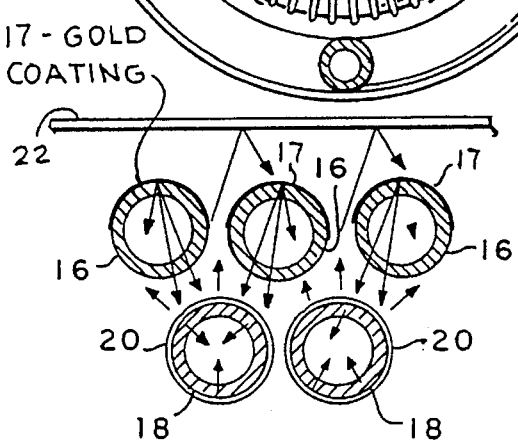
Fig. 8
Fig. 6
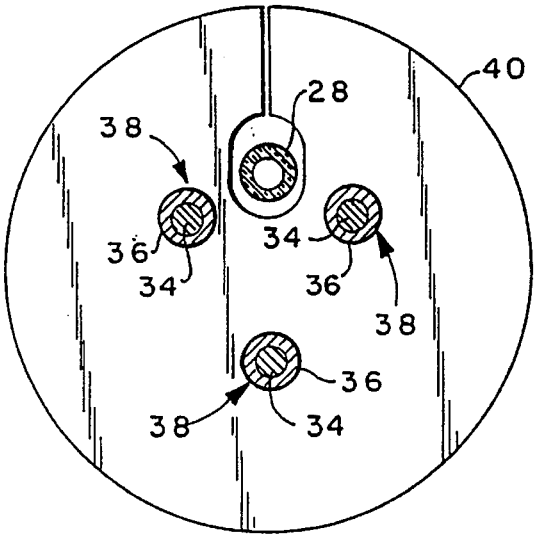

ULTRA PURE WATER HEATER WITH COAXIAL HELICAL FLOW PATHS

DESCRIPTION—TECHNICAL FIELD

The present invention relates to a high efficiency, non-contaminating fluid heater for heating an ultra pure fluid with a minimum amount of contamination as the ultra pure fluid passes through the fluid heater and, more particularly, to a high efficiency, non-contaminating fluid heater for heating ultra pure water for use in conditioning semiconductor wafers where the degree of contamination of the ultra pure water is critical.

BACKGROUND OF THE INVENTION

Fluid heaters are known for heating ultra pure water and other ultra pure fluids with a minimum amount of contamination. Examples of such a heater are disclosed in U.S. Pat. Nos. 3,870,033 and 3,983,361. The prior art heaters are complex, expensive, and only exhibit 80%–85% thermal efficiency. The present invention overcomes the disadvantages associated with the prior art by providing a relatively compact inexpensive heater for heating ultra pure fluids such as ultra pure water with a minimum amount of contamination and which exhibits a thermal efficiency of greater than 95%.

SUMMARY OF THE INVENTION

The present invention provides a new and improved high efficiency, non-contaminating fluid heater for heating an ultra pure fluid with a minimum amount of contamination as the ultra pure fluid passes through the fluid heater. The fluid heater includes an inner and outer helical passageway, both of which are tubular and formed from a substantially non-conductive, substantially inert, material. Each of the inner and outer helical passageways includes a helical outer surface and a helical tubular passageway therein through which the ultra pure fluid passes. The inner helical tubular passageway is in fluid communication with the outer helical tubular passageway and a coiled resistance heater is disposed about and in intimate contact with the helical outer surface of the inner helical passageway to heat by radiation, conduction and convection the ultra pure fluid which flows through the inner tubular helical passageway. The outer helical passageway is contiguous to and surrounds the inner helical passageway. The inner and outer passageways each have a longitudinal axis. The longitudinal axis of the inner passageway is coaxial to the longitudinal axis of the outer passageway, and the inner helical passageway, at least in part, supports the outer helical passageway. The ultra pure fluid, as it passes through the outer helical passageway, absorbs radiated and convected heat from the resistance heater which surrounds the inner helical passageway to increase the efficiency of the fluid heater. A housing formed from an infrared reflective material substantially encloses the inner and outer helical passageways to reflect inward and thereby reduce radiated heat flow from the coiled resistance heater to the ambient environment. The housing is covered with a non-particle shedding non-contaminating thermal insulation to further reduce heat flow to the ambient environment.

The present invention provides a new and improved high efficiency, non-contaminating fluid heater as set forth in the preceding paragraph, wherein the temperature of the coiled resistance heater is predetermined to maximize the absorption of infrared heat by the ultra pure fluid passing through the inner and outer helical passageways and wherein the temperature of the coiled resistance heater is between 1200° F. and 1800° F. to maximize heat absorption of radiated infrared energy by ultra pure water.

The present invention further provides a new and improved high efficiency, non-contaminating fluid heater for heating ultra pure fluid with a minimum amount of contamination as the ultra pure fluid passes through the fluid heater. The fluid heater includes first and second tubular members formed from an electrically non-conductive, substantially inert material, each of which has a generally helical configuration and includes an outer surface and a helical passageway through which the ultra pure fluid flows. The first and second tubular members each have longitudinal axis which are substantially coaxial and the helical passageway in the first tubular member is in fluid communication with the helical passageway in the second tubular member to provide for sequential flow therebetween. A resistance heater is disposed in intimate contact with the outer surface of the first tubular member for heating the ultra pure fluid which flows therethrough by radiation, conduction and convection. The second tubular member substantially surrounds the first tubular member and provides for the flow of the ultra pure fluid so that the ultra pure fluid absorbs radiated and convected heat from the resistance heater to increase the efficiency of the fluid heater. A housing formed from an infrared reflective material substantially surrounds the first and second tubular members to reduce the radiated heat flow from the resistance heater to the ambient environment. An insulation layer surrounds the housing to further reduce convective losses.

The present invention additionally provides a new and improved high efficiency, non-contaminating fluid heater as set forth in the preceding paragraph wherein the resistance heater is a coiled resistance wire and the temperature of the coiled resistance wire maximizes the absorption of infrared heat by the ultra pure fluid passing through the first and second tubular members and wherein the temperature of the coiled resistance wire is between 1200° F. and 1800° F. to maximize the heat absorption of radiated energy by the ultra pure water.

BRIEF DESCRIPTION OF THE DRAWINGS

FIG. 4 is a fragmentary view of the inner and outer helical passageways, more fully illustrating the support members and the insulating members.

FIG. 5 is a cross-sectional view taken approximately along the line 5A—5A of FIG. 4, more fully illustrating the inner and outer helical passageways and the support members.

FIG. 6 is a cross-sectional view taken approximately along the lines 6—6 of FIG. 4, more fully illustrating the insulating members.

FIG. 8 is a fragmentary schematic illustration of an embodiment of the invention wherein gold is sputtered on the outer surface of the outer helical passageway to increase the absorption of heat by the ultra pure fluid and which illustrates by arrows the path through which the radiant energy passes within the heater of the present invention.

DESCRIPTION OF THE PREFERRED EMBODIMENT

Figure 1:
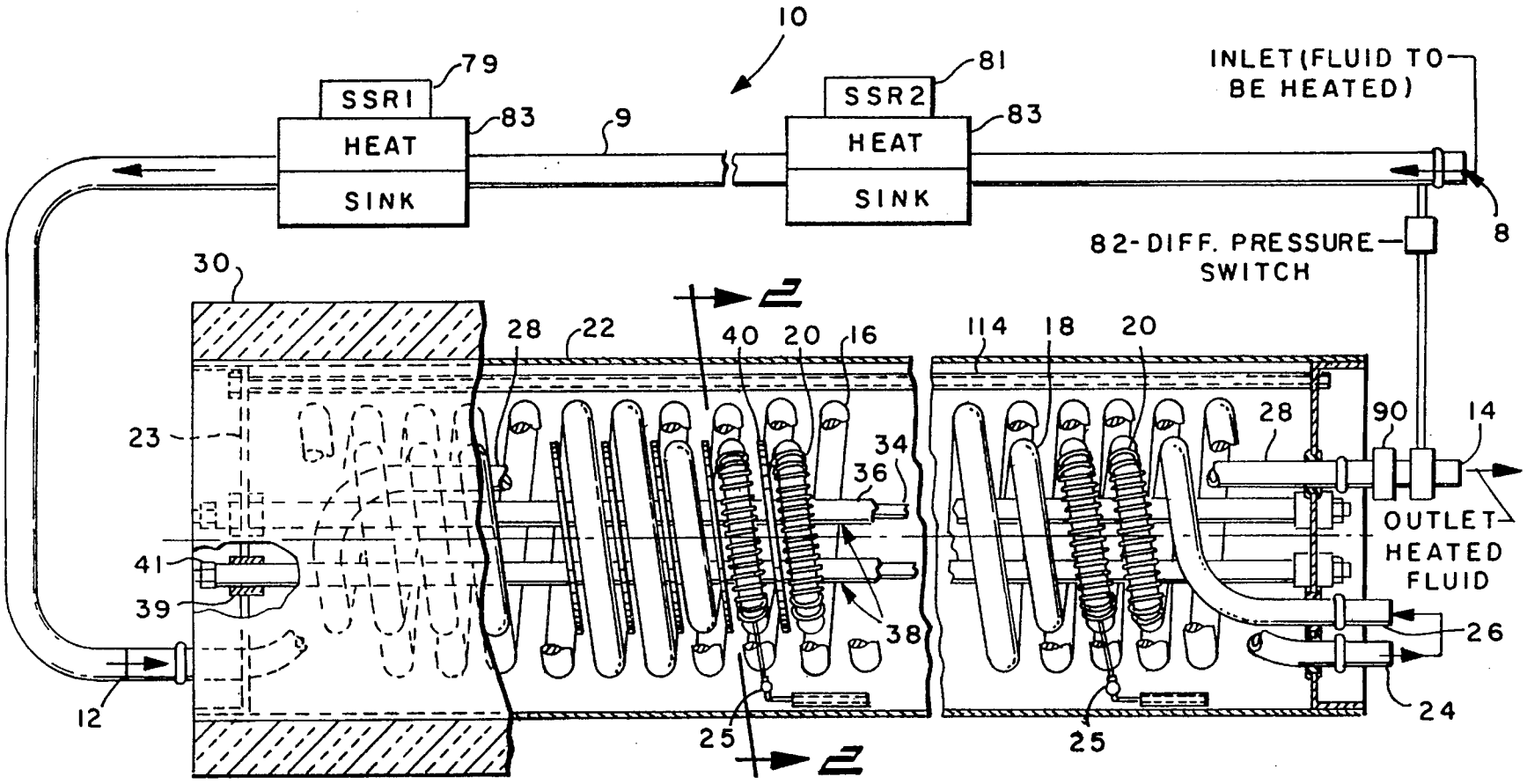
FIG. 1 is a side view partially sectioned of the high efficiency, non-contaminating fluid heater of the present invention showing portions of the housing and thermal insulation removed for clarity.

A high efficiency, non-contaminating fluid heater 10 is disclosed in the Figures. Referring more particularly to FIG. 1, the high efficiency, non-contaminating fluid heater 10 includes an inlet 8 which is adapted to receive an ultra pure fluid to be heated therein, and an outlet 14 through which the ultra pure fluid exits the fluid heater 10 after being heated therein. The fluid heater 10 is designed particularly for heating ultra pure water for use in industries such as the semi-conductor industry and the pharmaceutical industry where an ultra pure fluid must be heated without introducing contaminants into the fluid by the heating operation, While the present high efficiency, non-contaminating fluid heater 10 will be described as particularly adapted for heating ultra pure water, it should be appreciated that it can also be utilized to heat other fluids wherein it is desired not to introduce contaminates into the fluids during the heating operation.

The inlet 8 is connected via passageway 9 to an inlet 12 in the heater housing 22. The passageway 9 includes a pair of solid state relays 79 and 81 mounted thereon which are used to control the heater 10, as will be more fully disclosed hereinafter. Each of the solid state relays 79 and 81 is mounted on a heat sink 83 through which passageway 9 passes. When solid state relays 79 and 81 are energized, heat is generated therein which flows from the relays 79 and 81 to the heat sinks 83 where the energy is absorbed by the ultra pure fluid flowing through passageway 9 to preheat the fluid before the fluid flows into the heater housing 22 where the majority of heating occurs. Mounting the heat sinks on passageway 9 allows the recovery of a substantial amount of the heat energy dissipated by the solid state relays 79 and 81.

If the ultra pure fluid has an inlet temperature in excess of 25° C., the solid state relays 79 and 81 are mounted on ambient air cooled heat sinks (not illustrated) and no heat recovery is effected.

The fluid heater 10 includes an outer helical passageway 16 and an inner helical passageway 18 through which the ultra pure fluid sequentially passes as the fluid is heated. The inlet 12 is connected to the outer helical passageway 16 and introduces the fluid to be heated therein. The fluid to be heated passes through the outer helical passageway 16 and exits the outer helical passageway 16 at 24, where it is introduced through an inlet 26 to the inner helical passageway 18. The inner helical passageway 18 includes a resistance heater 20 disposed in intimate contact with the helical outer surface of the helical inner passageway 18 to effect heating of the ultra pure fluid by radiation, conduction and convection. After the fluid sequentially passes through the outer helical passageway 16 and through the inner helical passageway 18, the fluid is directed through a return passageway 28 which passes longitudinally through the interior of the outer and inner helical passageways 16, 18 to connect with the outlet 14. The ultra pure fluid to be heated is preheated as it passes through the solid state relay heat sinks 83 and the outer helical passageway 16 and is further heated as it passes through the inner helical passageway 18 whose outer surface is in intimate contact with the resistance heater 20. Further, heating of the ultra pure fluid occurs as the fluid flows from the inner helical passageway 18 through the return passageway 28 to the outlet 14. The helical passageways provide for a dynamic internal fluid circulation by the ultra pure fluid passing therethrough. This internal dynamic circulation enables the fluid to have a wiping effect on the walls of the helical passageways and a mixing action to provide for efficient absorption of heat by the fluid as it passes through the helical passageways. This circulation effects an internal secondary flow which enhances the absorption of conductive and convective heat.

A housing 22, formed from an infrared reflective material such as polished or plated sheet metal, substantially encloses the inner and outer helical passageways 16, 18 to reflect (re-introduce) and reduce radiated heat flow from the resistance heater 20 to the ambient environment outside of the housing 22. A thermal insulation blanket 30 covers the exterior of the housing 22 to further reduce the heat flow from the resistance heater 20 to the ambient environment. The thermal insulation blanket is preferably formed from Solimide Polyamide foam which is non-particle generating, fire resistant and a good thermal insulator. The infrared reflective housing 22 and the thermal insulation 30 traps heat from the resistance heater 20 inside the housing 22 where the heat is absorbed by the ultra pure fluid to heat the fluid in an efficient manner. The construction of the present fluid heater 10 has been found to provide a heater having a thermal efficiency of better than 95%.

Figure 2:
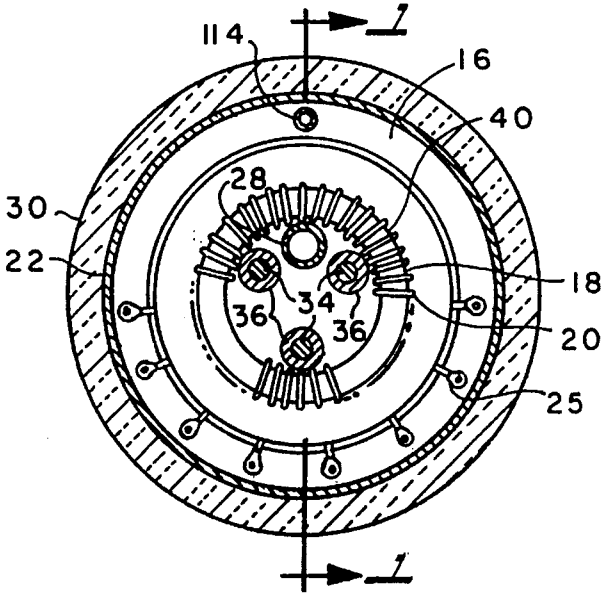
FIG. 2 is a cross-sectional view more fully illustrating the high efficiency, non-contaminating fluid heater taken approximately along the line 2—2 of FIG. 1.
Figure 3:
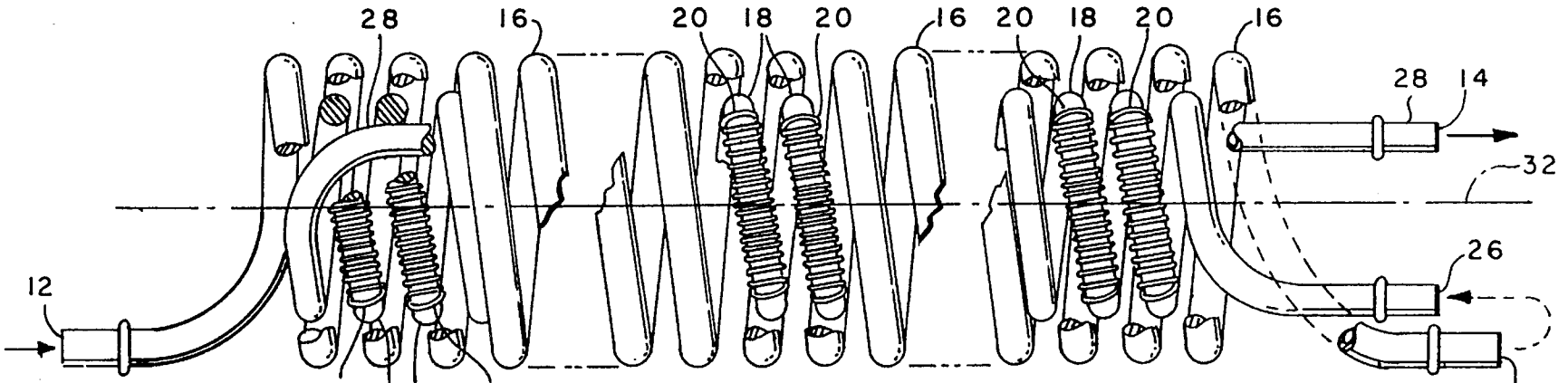
FIG. 3 is a side view of the inner and outer helical passageways and coiled resistance heater illustrated for clarity with the support rods and insulating members removed.

FIG. 3 more fully illustrates the construction of the outer helical passageway 16 and the inner helical passageway 18. The outer helical passageway 16 and inner helical passageway 18 are both disposed coaxial to a longitudinal axis 32 which is preferably disposed in a substantially horizontal position. The resistance heater 20 is a coiled resistance heater which is coiled along substantially the entire length of the outer surface of the inner helical passageway 18 to effect rapid and efficient heating of the ultra pure fluid as it passes through the outer helical passageway 16 and inner helical passageway 18. Both the outer helical passageway 16 and the inner helical passageway 18 are disposed coaxial to the longitudinal axis 32 and both the inner helical passageway and the outer helical passageway are disposed substantially coaxial to each other. The fluid to be heated is introduced into the inlet 12 of the outer helical passageway 16. The fluid then passes through the outer helical passageway 16 where it absorbs radiated and convective heat from the coiled resistance heater 20 which surrounds the inner helical passageway 18. The fluid flowing through the outer helical passageway 16 is thus preheated prior to entering the inner helical passageway 18 at the inlet 26 thereof. The outer helical passageway 16 acts to increase the efficiency of the fluid heater 10 by absorbing any heat which is radiated from the coiled resistance heater 20 or which flows in a convective fashion therefrom. The preheated, ultra pure fluid then enters the inner helical passageway 18, whose outer surface is in intimate contact with the coiled resistance heater 20. As the fluid flows through the coiled helical passageway 18, the fluid is heated by radiation, conduction and convection from the coiled resistance heater 20. After the fluid flows through the inner helical passageway 18, it passes through the return passageway 28 which is disposed parallel to the longitudinal axis 32, and which is also in close proximity with the coiled resistance heater 20 as is more fully illustrated in FIG. 2.

The fluid to be heated passes three times substantially the entire length of the fluid heater 10 in a direction substantially parallel to the longitudinal axis 32 of the fluid heater 10 to effect efficient heating of the ultra pure fluid. The fluid first passes the entire length of the housing through the outer helical passageway 16, then passes substantially the entire length of the housing through the inner helical passageway 18 which has its outer surface in intimate contact with the coiled resistance heater 20, and then through the return passageway 28 which is disposed substantially parallel to the longitudinal axis 32 and which has its outer surface in close proximity with the coiled resistance heater 20. The construction of the present fluid heater 10 substantially increases the heat transfer from the coiled resistance heater 20 to the ultra pure fluid. Such a construction, when disposed in an insulated and infrared, reflective housing 22, has been found to have a thermal efficiency in excess of 95%.

A plurality of elongate support means 38 extend in a substantially horizontal direction substantially parallel to the longitudinal axis 32 of the fluid heater 10, as is illustrated in FIGS. 1 and 4. The elongate support means 38 include metallic support rods 34 which are surrounded by a sleeve 36 formed from an electrically insulative material which is inert at high temperatures. The metallic support rods 34 provide support in a horizontal direction for the inner helical passageway 18 to prevent the passageway 18 from sagging when the coiled resistance wire 20 is energized and the fluid passageway is filled with the fluid to be heated. The insulative, high temperature sleeve 36 which surrounds the metallic support rod 34 engages the inner cylindrical surface of the inner helical passageway 18 and the coiled resistance heater 20, as is more fully illustrated in FIGS. 2 and 5. The metallic support rod 34 is preferably formed from stainless steel and the insulative, high temperature sleeve 36 is preferably formed from quartz tubing. The quartz tubing 36 prevents the support rods 34 from becoming electrically energized due to contact with the coiled resistance heater 20. FIG. 1 shows the support means 38 are supported by suitable spacer 39 in each of the end walls 23 of the housing 22 and a support rod nut 41 threadably engages the end of the stainless steel support rod 34 to positively locate and support the support means 38 in the end wall 23.

A plurality of annular insulator members 40 are disposed between adjacent coils of the inner helical passageway 18, as is more fully illustrated in FIGS. 1 and 4. The insulative spacers 40, which are preferably formed from mica, prevent electrical engagement of adjacent coils of the inner helical passageway 18 and engagement between the coils of the resistance heater 20 which are disposed on adjacent coils of the inner helical passageway 18. As is more fully illustrated in FIG. 6, the insulative members or mica spacers 40 preferably have an annular configuration with a plurality of openings disposed therein and through which the support means 38 pass. An opening is provided in each of the mica spacers 40 for the return passageway 28. In addition, each mica spacer is partially slit to permit the spacer to conform to the helical inner passageway.

The inner and outer helical passageways 18, 16 are both, in the preferred embodiment of the invention, formed from quartz tubing. When the helical passageways are filled with a fluid to be heated and the resistance heater 20 is energized, the quartz passageways tend to sag. The elongate support means 38 supports the inner helical passageway 18 in a vertical direction and prevents sagging of the inner helical passageway 18 when the coiled resistance heater 20 is filled with fluid and energized. The inner helical passageway 18 in turn supports the outer helical passageway 16 to prevent sagging of the outer helical passageway in a vertical direction. If the outer helical passageway 16 sags in a vertical direction, the outer helical passageway will engage the coiled resistance heater 20 and the inner helical passageway 18 which is supported by the support means 38 to prevent further sagging of the outer helical passageway 16

The components of the high efficiency, non-contaminating fluid heater 10 are constructed to minimize the introduction of contaminates into the ultra pure fluid to be heated during the heating process and to maximize the transfer of heat from the coiled resistance heater 20 into the fluid to be heated. To this end, the outer helical passageway 16 and the inner helical passageway 18 are formed from an electrically non-conductive material which is substantially inert in the presence of ultra pure fluids such as ultra pure water. In the preferred embodiment, the outer helical passageway 16 is constructed of opaque quartzglass, and the inner helical passageway 18 is constructed of transparent quartzglass. The primary difference between transparent quartzglass and opaque quartzglass is the white, opaque appearance of opaque quartzglass. The effect is based on the special structure of the material forming the opaque quartzglass which scatters light and thermal radiation in a very efficient and homogeneous way. Transparent quartzglass enhances the direct transmission of radiant energy. Opaque quartzglass suppresses the transmission of radiant energy to optimize and redirect the radiant energy back to the fluid to be heated in the inner fluid passageway 18. Both transparent quartzglass and opaque quartzglass are suitable for high application temperatures and have excellent temperature shock resistance, low coefficients of thermal expansion, low thermal conductivity, high chemical purity, and outstanding chemical resistance. Opaque quartzglass and transparent ultra pure quartzglass are sold by Heraeus Quarzglas GmbH, Industrial Products Division, PCI Hanau, Germany.

When the resistance heater 20 is energized, heat is directed by conduction, convection and radiation to the ultra pure water passing through the heater 10. The opaque quartzglass of the outer passageway 16 acts to reflect radiant energy back toward the inner passageway 18 to heat the fluid passing therethrough. Although transparent, quartzglass can be used for the outer passageway 16. The use of opaque quartzglass is preferred in the outer passageway due to its reflective properties which further enhance the heating of the fluid as it passes through the inner passageway. FIG. 8 schematically illustrates an embodiment of the heater 10 wherein transparent quartzglass with a reflective surface 17 located on the outside of the outer passageway 16 is utilized to further enhance the efficiency of the heater 10 by redirecting radiant energy back to the inner helical passageway 18. In this embodiment, the reflective surface 17 can be a sputtered coating of gold which is dispersed approximately one-half way around the outside of the quartzglass which forms the outer helical passageway 16. The reflective coating, as illustrated by the arrows in FIG. 8, redirects radiant energy to the inner passageway 18 to enhance the heating of the ultra pure fluid. While opaque quartzglass can be utilized for the outer passageway 16 to reflect and redirect radiant energy to the inner passageway 18, the use of the sputtered reflective surface 17 can also accomplish the same results in a slightly more efficient manner.

The temperature of the coiled resistance heater 20 is designed to maximize the absorption of infrared heat by the ultra pure fluid and particularly ultra pure water passing through the inner helical passageway 18. To this end, in the preferred embodiment of the invention, the coiled resistance heater 20 generates a temperature of between 1200° F. and 1800° F. with about 1500° F. being the preferred temperature to maximize the heat absorption of radiated infrared energy by the ultra pure water passing through the inner helical tubular passageway 18. The coiled resistance heater 20 is constructed such that the diameter of the coils, the spacing between adjacent coils, the resistive alloy from which the resistive wire is formed, and the diameter of the resistive wire are all designed so that the current flow through the resistance wire achieves a predetermined temperature to maximize infrared heat absorption in ultra pure water. To this end, in the preferred embodiment, the coiled resistance heater 20 generates infrared energy to heat the ultra pure water which has a wavelength of between 2 and 5 microns. The peak absorption point for ultra pure water is between 2.6 and 3.0 microns and it is preferable to limit the wavelength of the infrared energy to this range to maximize the efficiency of the heater 10. The ultra pure quartz from which the helical passageways 16 and 18 are formed has a transmittance value of greater than 85% to infrared energy of a wavelength of between 2.0 and 4.3 microns to maximize the heating of ultra pure water passing through the inner helical passageway. In the preferred embodiment, the coiled resistance heater is Kanthal "D" heating wire (22% Cr, 4.8% Al, and remainder Fe), gauge number 16, wound over a 0.438" diameter mandrel having a completed coil resistance of approximately 13.3 ohms, which will be energized by 240 volt, three-phase, alternating current. The Kanthal "D" heating wire coil is then stretched to a finished length of 36" and is energized at 208 volts and heated to incandescence for 5 to 6 minutes before assembly to provide coil passivation. This provides a low voltage, electrically insulating film around the resistance wire to provide for coil to coil insulation.

Figure 7:
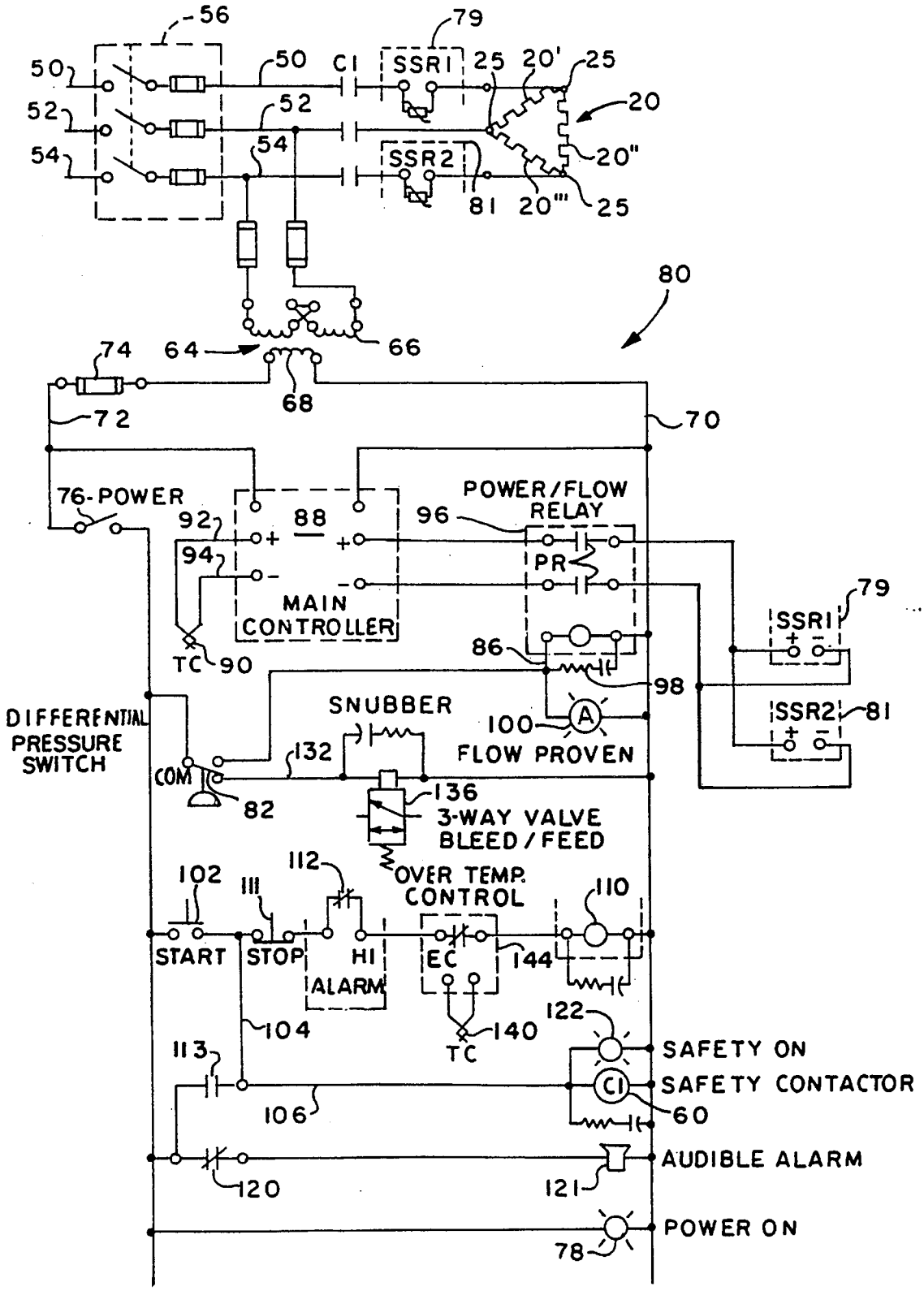
FIG. 7 is a schematic illustration of the control circuitry for controlling the high efficiency, non-contaminating fluid heater of the present invention.

A schematic control diagram for controlling the heater 10 is more fully disclosed in FIG. 7. This control is similar to the control disclosed in U.S. Pat. No. 4,396,564 entitled "Tubular High Efficiency, Non-Contaminating Fluid Heater" assigned to the assignee of the present invention and which is incorporated herein by reference. The control disclosed in U.S. Pat. No. 4,396,564 could be used with small modifications to control the heater 10 of the present invention. The control of the present invention, illustrated in FIG. 7, includes a power supply which is preferably a three-phase power supply, including power conductors 50, 52 and 54 to effect energization and control of the electrical resistance heaters 20. While the electrical resistance heater 20 is described as a coil resistance heater, in the preferred embodiment of the invention, the resistance heater 20 is a three-phase heater, and resistance heater 20 includes coil resistance heaters 20', 20" and 20'", as well known in three phase heaters. Each of the resistance heaters 20', 20" and 20'" is energized via a power tap 25, two of which are illustrated in FIG. 1. The lines 50, 52, 54 pass through a fuse power disconnect 56 or circuit breaker to energize the electrical resistance heaters 20', 20" and 20'". Normally open contacts C1 are provided in each of the lines 50, 52, 54 between the disconnect 56 and the electrical resistance heaters 20. Contacts C1 in each of the lines 50, 52 and 54 are associated with a safety relay 60 to be more fully described hereinbelow. Normally open contacts of solid state relay SSR1 and SSR2, 79 and 81, respectively, are provided in lines 50 and 54 to control the power to the heaters 20', 20" and 20'". The contact SSR1s and SSR2 are controlled by the solid state relays 79, 81, respectively, as will be more fully described hereinbelow. Solid state relays 79, 81 include terminals SSR1 and SSR2 which are either conductive or nonconductive depending on the input to solid state relays 79, 81. While the terminals will be described as contacts for simplicity, it should be realized that terminals are not contacts but in fact are semiconductor junctions which are rendered conductive and nonconductive. The solid state relays 79, 81 could be replaced with a standard heating contactor for energizing each of the heaters 20', 20", 20'".

A fused step-down transformer 64, having its primary 66 connected across lines 52 and 54, is provided to energize the control circuit 80 at a low electrical potential (24 volts). The secondary 68 of transformer 64 energizes the power buses 70 and 72 of the control circuit 80. The bus is fused at 74 for short circuit protection.

A main on/off power switch 76 is provided for energizing the control circuit 80. The control circuit 80 includes solid state power relays 79, 81 for controlling the power to the heaters 20. The solid state power relays 79, 81, illustrated in FIG. 1, are preferably mounted on heat sinks 83 which in turn are mounted on an inlet line 9 which directs fluid to be heated to the inlet 12. The fluid to be heated absorbs a substantial amount of heat from the solid state power relays 79, 81 via the heat sinks 83 to further increase the efficiency of the heater 10. When the main power switch 76 is closed, the power buses 70 and 72 are energized and an indicator light 78 connected across buses 70 and 72 is energized. The main power switch 76 is connected to bus 72 and to two position differential pressure switch 82. The differential pressure switch 82 is connected across the inlet 8 and the outlet 14 of the heater 10 and is operable to sense flow between the inlet and outlet of the heater. The output of the differential pressure switch 82 is connected to an input 86 of a power flow relay 96 for energizing the solid state power relays 79, 81 to permit power flow through terminals SSR1 and SSR2 to energize heater 20. When fluid flow above a predetermined volume is present in the heater assembly 10, differential pressure switch 82 closes to apply a potential at terminal 86 of the power flow relay 96 to close contacts PR and energize power relays 79 and 81. Energization of power relays 79 and 81 effects energization of heater 20. A surge suppressor 98, consisting of a resistor and capacitor, is provided to reduce the electromagnetic surge when power flow relay 96 is energized or de-energized. An indicator light 100 is energized when differential pressure switch 82 senses the predetermined fluid flow. A digital temperature controller 88 such as an Anafaze Model 8CLS sold by Anafaze Measurement Control, Watsonville, Calif. is utilized to control the power to power flow relay 96 and solid state power relays 79, 81. Energization of control 88 effects energization of solid state power relay 79, 81 when a temperature sensor 90 which, in the preferred embodiment, is a thermocouple device 90, which is connected at 92 and 94 to the digital temperature controller 88 detects that the temperature of the fluid exiting the heater 10 is below the preset temperature entered into control 88 and differential pressure switch 82 senses the predetermined flow. The thermocouple 90 is located on the outlet 14 of the heater 10 to sense the temperature of the ultra pure fluid exiting the heater 10.

When the solid state power relays 79, 81 are energized and power can be permitted to conduct, the electrical resistance heaters 20', 20", 20'" are not energized as a result of the normally open contacts C1 in the lines 50, 52, 54. In order to close each of the safety contacts C1, a safety start button 102 must be manually depressed subsequent to closing of power switch 76. The safety start button 102 is connected via lines 104 and 106 to the safety relay 60. When the safety start button 102 is manually depressed, the safety relay 60 will be connected across energized power buses 70 and 72, and relay 60 will be energized to close contacts C1 to effect energization of the electrical resistance heater 20.

The safety start button 102 is series connected with an emergency stop button 111, normally closed high fluid temperature alarm contacts 112, an overtemperature controller 144, and relay coil 110. The high fluid temperature alarm contacts 112 are controlled by the control 88 and open in the event that a fluid overtemperature condition is sensed by the temperature sensor 90 and controller 88. The overtemperature controller 144 includes normally closed contacts EC which open when an overtemperature condition is sensed. The overtemperature controller 144 is connected to a thermocouple 140 installed in a quartz thermowell 114 which is located within housing 22 and runs substantially the entire length of the housing to sense the internal temperature of the heater 10. The safety relay 110 is de-energized in the event the heater temperature, as sensed by the thermocouple 140, exceeds a predetermined temperature and contacts EC open.

When the safety start button 102 is manually depressed, relay 110 will be energized. Normally open contacts 113 and normally closed contacts 120 are associated with the relay 110. When relay 110 is energized, the normally open contacts 113 will close to provide a holding circuit which energizes safety relay 60 and a light 122 and normally closed contacts 120 will be opened. An audible alarm, such as illustrated at 121, is series connected between the power buses 70 and 72 with the normally closed contacts 120. When the relay 110 is energized, contacts 120 open to prevent energization of the alarm 122. De-energization of relay 110 will effect closing of contacts 120 to energize alarm 122 and opening of contacts 113 to de-energize relay 60 and open contacts C1. While an audible alarm has been disclosed, other types of annunciators could be utilized.

In the event that the emergency stop button 111 is depressed, relay 110 is de-energized, or if temperature controller 144 senses a temperature in excess of a predetermined temperature, contacts EC open and relay 110 will be de-energized. Additionally, if the digital controller 88 senses a fluid overtemperature, contacts 112 will open and relay 110 will be de-energized.

De-energization of relay 110 will effect de-energization of safety relay 60 and energization of alarm 122. The electrical resistance heaters 20', 20", 20'" will be de-energized by the opening of contacts C1 associated with the safety relay 60.

The overtemperature control 144 is series connected with relay 110. The overtemperature control 144 provides a further safety control to effect de-energization of relay 110 in the event that the temperature of the heater 10 as sensed by thermocouple 140 in thermowell 114 is in excess of a predetermined temperature.

When fluid flow between the inlet 8 and outlet 14 of the fluid heater 10 ceases, as sensed by the differential pressure switch 82, the differential pressure switch 82 will open to cause power/flow relay 96 to de-energize and open contact PR to de-energize solid state power relays 79, 81 to de-energize the electrical resistance heaters 20', 20", 20'". When the differential pressure switch 82 senses that the fluid flow has fallen below the predetermined value, the differential pressure switch 82 moves to a position in which a three-way valve 136 is energized to bleed fluid flow to a drain. When valve 136 bleeds, the ultra pure fluid in the inner and outer helical passageways 16 and 18 removes residual heat from the de-energized resistance heaters 20', 20", 20'".

From the foregoing, it should be apparent that a high efficiency, non-contaminating fluid heater for heating ultra pure water and ultra pure fluid as it passes through the fluid heater 10 has been described. The fluid heater 10 includes an inner helical passageway 18 and an outer helical passageway 16, both of which are tubular and formed from an electrically non-conductive material which is substantially inert in the presence of ultra pure fluid. Each of the inner and outer helical passageways has a helical outer surface and a helical tubular passageway therein through which the ultra pure fluid passes as it is heated. The inner helical tubular passageway 18 is in fluid communication with the outer helical tubular passageway 16 to provide for sequential fluid flow between the inner and outer helical passageways. A coiled resistance heater 20 is disposed about and is in intimate contact with the outer surface of the inner helical passageway 18. The coiled resistance heater 20 is adapted to be energized to heat by radiation, conduction and convection the ultra pure water which flows through the inner tubular helical passageway 18. The outer helical passageway 16 substantially surrounds the inner helical passageway 18, and the inner helical passageway 18 has a longitudinal axis which is substantially coaxial with the longitudinal axis of the outer helical passageway 16. The inner helical passageway 18, at least in part, supports the outer helical passageway 16. The outer helical passageway is disposed to enable the ultra pure fluid flowing therethrough to absorb radiated and convected heat from the coiled resistance heater which surrounds the inner helical passageway 18 to increase the efficiency of the fluid heater 10. A housing 22, formed from an infrared reflective material, substantially encloses the inner and outer helical passageways 16, 18 to reduce radiated heat flow from the coiled resistance heater to the ambient environment. An insulation layer 30 is disposed adjacent to the housing 22 to further reduce conductive heat flow from the coiled resistance heater 20 to the ambient environment to thereby increase the efficiency of the fluid heater.

What we claim is:

1. A high efficiency, non-contaminating fluid heater for heating ultra pure water with a minimum amount of contamination as the ultra pure water passes through the fluid heater, comprising an inner and an outer helical passageway, both of which are tubular and formed from an electrically nonconductive material which is substantially inert in the presence of ultra pure water, each of said inner and outer helical passageways having a helical outer surface and defining a helical tubular passageway therein through which said ultra pure water passes as it is heated, said inner helical tubular passageway being in fluid communication with said outer helical tubular passageway and providing for sequential fluid flow between said inner and outer helical passageways, a coiled resistance heater disposed about and being in intimate contact with said helical outer surface of said inner helical passageway, said coiled resistance heater when energized having a temperature of at least 1200° F. to maximize the production of infrared energy having a wavelength of between 2 and 4.3 micron to heat by radiation, conduction and convection the ultra pure water which flows through said inner tubular helical passageway, said outer helical passageway substantially surrounding said inner helical passageway, said inner helical passageway having a longitudinal axis and said outer helical passageway having a longitudinal axis which is substantially coaxial with said longitudinal axis of said inner helical passageway, said longitudinal axes of said inner and outer helical passageways being substantially horizontally disposed, said inner helical passageway at least in part supporting said outer helical passageway, said outer helical passageway being disposed to enable the ultra pure water flowing therethrough to absorb radiated and convective heat from said coiled resistance heater which surrounds said inner helical passageway to increase the efficiency of the fluid heater, and housing means formed from an infrared reflective material substantially enclosing said inner and outer helical passageways to reduce radiated heat flow from said coiled resistance heater to the ambient environment.

2. A high efficiency, non-contaminating fluid heater as defined in claim 1 further including an insulation layer disposed adjacent to said housing means to further reduce convective heat flow from said coiled resistance heater to the ambient environment to thereby increase the efficiency of the fluid heater.

3. A high efficiency, non-contaminating fluid heater as defined in claim 1 wherein the temperature of said coiled resistance heater maximizes the absorption of infrared heat by the ultra pure water passing through said inner and outer helical passageways.

4. A high efficiency, non-contaminating fluid heater as defined in claim 3 wherein the temperature of said coiled resistance heater is between 1200° F. and 1800° F. to maximize the heat absorption of radiated infrared energy by the ultra pure water passing through said inner and outer helical tubular passageways.

5. A high efficiency, non-contaminating fluid heater as defined in claim 4 wherein said coiled resistance heater is formed from a resistive alloy and includes a plurality of coils of resistance wire and wherein the diameter of the wire, the spacing between adjacent coils of resistance wire, the resistive alloy from which the resistance wire is formed and the current flow through the resistance wire predetermines the temperature of said coiled resistance heater to maximize the infrared heat absorption of the ultra pure water passing through said inner and outer helical passageways and to provide infrared energy to heat the ultra pure water which has an effective radiant energy absorption of a wavelength of between 2 and 4.3 microns.

6. A high efficiency, non-contaminating fluid heater as defined in claim 5 wherein said inner and outer helical passageways are formed from ultra pure quartz which has a low level of potentially contaminating ions therein to minimize contamination of the ultra pure water passing through said inner and outer helical passageways while maximizing the infrared heat absorption by the helical tubular passageways.

7. A high efficiency, non-contaminating fluid heater as defined in claim 1 wherein said inner and outer helical passageways are formed from ultra pure quartz which has a transmittance value of greater than 85% for infrared energy having a wavelength of between 2 to 4.3 microns to maximize the radiant heating of the ultra pure water passing through said inner and outer helical passageways while minimizing the heat absorption by the helical tubular passageways.

8. A high efficiency, non-contaminating fluid heater as defined in claim 7 further including elongate support means extending in a substantially horizontal direction for supporting said inner helical passageway to prevent sagging thereof when said coiled resistance heater is energized.

9. A high efficiency, non-contaminating fluid heater as defined in claim 1 wherein said inner and outer helical passageways each include a plurality of annular coils and further including a plurality of annular insulator members each of which is disposed between adjacent coils of said inner helical passageway to prevent engagement of the plurality of coils of said resistance heater with each other.

10. A high efficiency, non-contaminating fluid heater as defined in claim 1 wherein said coiled resistance heater is in intimate contact with said helical outer surface of said inner helical passageway and is prevented from being in contact with the ultra pure water to prevent said coiled resistance heater from introducing contaminates into the ultra pure water.

11. A high efficiency, non-contaminating fluid heater as defined in claim 1 further including power means for energizing said coiled resistance heater, heat sink means for supporting said power means and absorbing heat from said power means, and wherein said heat sink means is cooled by the ultra pure water to further enhance the efficiency of the heater and heat the ultra pure water passing therethrough.

12. A high efficiency, non-contaminating fluid heater as defined in claim 1 wherein said outer surface of said outer helical passageway is at least in part reflective to reflect radiant energy from said coiled resistance heater to heat the ultra pure water passing through said inner and outer helical passageways.

13. A high efficiency, non-contaminating fluid heater as defined in claim 12 wherein said outer surface of said helical passageway has a gold coating to reflect radiant energy from the coiled resistance heater toward the ultra pure water passing through said inner and outer helical passageways.

14. A high efficiency, non-contaminating fluid heater for heating an ultra pure fluid with a minimum amount of contamination as the ultra pure fluid passes through the fluid heater comprising first and second tubular members formed from an electrically nonconductive, substantially inert material, each of said tubular members having a generally helical configuration and including an outer surface and a helical passageway through which the ultra pure fluid flows, each of said first and second tubular members having a longitudinal axis with said longitudinal axes being substantially coaxial, said helical passageway in said first tubular member being in fluid communication with said helical passageway in said second tubular member and providing for the sequential flow of fluid between said helical passageways and said first and second members, said second tubular member substantially surrounding said first tubular member, a resistance heater disposed in intimate contact with said outer surface of said first tubular member, said resistance heater when energized having a temperature of at least 1200° F. for heating the ultra pure fluid which flows through said helical passageway in said first tubular member by radiation, conduction and convection, said ultra pure fluid flowing through said second tubular member absorbing radiated and convective heat from said resistance heater to increase the efficiency of said fluid heater and a housing formed from an infrared reflective material substantially surrounding said first and second tubular members to reduce the radiated heat flow from said resistance heater to the ambient environment to increase the efficiency of the fluid heater and wherein said outer surface of said first tubular member at least in part supports said second tubular member to prevent sagging of said second tubular member when said second tubular member is filled with fluid and said resistance heater is energized.

15. A high efficiency, non-contaminating fluid heater as defined in claim 14 further including an insulation layer disposed adjacent to and surrounding said housing to further reduce passage of convective heat flow from said resistance heater to the ambient environment to thereby increase the efficiency of said heater.

16. A high efficiency, non-contaminating fluid heater as defined in claim 14 wherein said longitudinal axis of said first and second tubular members are substantially coaxial and horizontally disposed and further including elongate support means extending in a substantially horizontal direction for supporting said first tubular member to prevent sagging thereof when said resistance heater is energized.

17. A high efficiency, non-contaminating fluid heater as defined in claim 14 wherein said resistance heater is a coiled resistance wire and the temperature of said coiled resistance wire maximizes the absorption of infrared heat by the ultra pure fluid passing through said first and second tubular members.

18. A high efficiency, non-contaminating fluid heater as defined in claim 17 wherein the temperature of said coiled resistance wire is designed to produce a specific operating temperature of between 1000° F. and 1800° F. to permit heat absorption of radiated infrared energy by a specific maximum ultra pure fluid passing through said first and second tubular members.

19. A high efficiency, non-contaminating fluid heater as defined in claim 18 wherein said resistance heater is a coiled resistance heater formed from a resistive alloy and includes a plurality of coils of resistance wire and wherein the diameter of said resistance wire, the spacing between adjacent coils of said resistance wire, the resistance alloy from which the resistance wire is formed, and the current flow through said resistance wire predetermines the temperature of said coiled resistance heater to maximize the infrared heat absorption of the ultra pure fluid passing through said helical passageways in said first and second tubular members.

20. A high efficiency, non-contaminating fluid heater as defined in claim 19 wherein said coiled resistance wire provides infrared energy to heat the ultra pure fluid passing through said first and second tubular members which has a wavelength of between 2 and 3.5 microns.

21. A high efficiency, non-contaminating fluid heater as defined in claim 14 wherein said first and second tubular members are formed from ultra pure quartz which has a transmittance value of greater than 85% for infrared energy having a wavelength of between 1.8 and 3.54 microns to maximize the radiant heating of the ultra pure fluid while minimizing the heat absorption by the first and second tubular members.

22. A high efficiency, non-contaminating fluid heater as defined in claim 21 wherein said resistance heater is a coiled resistance wire which when energized provides infrared energy having a wavelength of between 2 and 3.5 microns to heat the ultra pure fluid.

23. A high efficiency, non-contaminating fluid heater as defined in claim 14 wherein said first and second tubular members are formed from ultra pure quartz which has a low level of potentially contaminating ions therein to minimize contamination of the ultra pure fluid passing through said first and second tubular members while maximizing the infrared heat absorption by said first and second tubular members.

24. A high efficiency, non-contaminating fluid heater as defined in claim 14 wherein said resistance heater is in intimate contact with said outer surface of said first tubular member and is prevented from being in contact with the ultra pure fluid which passes through said first and second tubular members to prevent said resistance heater from introducing contaminates into the ultra pure fluid.

25. A high efficiency, non-contaminating fluid heater as defined in claim 14 wherein said helical passageways in said first and second tubular members create a secondary flow substantially perpendicular to said helical passageways to enhance the thermal transfer of heat from said resistance heater by conduction and convection.

26. A high efficiency, non-contaminating fluid heater as defined in claim 14 further including power means for energizing said coiled resistance heater, heat sink means for supporting said power means and absorbing heat from said power means, and wherein said heat sink means is cooled by the ultra pure fluid to further enhance the efficiency of the heater and heat the ultra pure fluid passing therethrough.

27. A high efficiency, non-contaminating fluid heater as defined in claim 14 wherein said outer surface of said outer helical passageway is at least in part reflective to reflect radiant energy from said coiled resistance heater to heat the ultra pure fluid passing through said inner and outer helical passageways.

28. A high efficiency, non-contaminating fluid heater as defined in claim 27 wherein said outer surface of said helical passageway has a gold coating to reflect radiant energy from the coiled resistance heater toward the ultra pure fluid passing through said inner and outer helical passageways.

29. A high efficiency, non-contaminating fluid heater for heating ultra pure water with a minimum amount of contamination as the ultra pure water passes through the fluid heater, comprising an inner and an outer helical passageway, both of which are tubular and formed from an electrically nonconductive material which is substantially inert in the presence of ultra pure water, each of said inner and outer helical passageways having a helical outer surface and defining a helical tubular passageway therein through which said ultra pure water passes as it is heated, said inner helical tubular passageway being in fluid communication with said outer helical tubular passageway and providing for sequential fluid flow between said inner and outer helical passageways, a coiled resistance heater disposed about and being in intimate contact with said helical outer surface of said inner helical passageway, said coiled resistance heater being adapted to be energized to heat by radiation, conduction and convection the ultra pure water which flows through said inner tubular helical passageway, said outer helical passageway substantially surrounding said inner helical passageway, said inner helical passageway having a longitudinal axis and said outer helical passageway having a longitudinal axis which is substantially coaxial with said longitudinal axis of said inner helical passageway, said inner helical passageway at least in part supporting said outer helical passageway, said outer helical passageway being disposed to enable the ultra pure water flowing therethrough to absorb radiated and convective heat from said coiled resistance heater which surrounds said inner helical passageway to increase the efficiency of the fluid heater, and housing means formed from an infrared reflective material substantially enclosing said inner and outer helical passageways to reduce radiated heat flow from said coiled resistance heater to the ambient environment and wherein said longitudinal axes of said inner and outer helical passageways are substantially coaxial and horizontally disposed and further including elongate support means extending in a substantially horizontal direction for supporting said inner helical passageway to prevent sagging thereof when said coiled resistance heater is energized, said elongate support means including a plurality of support rods and a plurality of tubular support members, each of said support rods being located in one of said tubular support members, said tubular support members being formed from an electrically insulative material which is capable of retaining its insulating properties at high temperatures, said support rods and tubular support members supporting said inner helical passageway to prevent sagging thereof.

30. A high efficiency, non-contaminating fluid heater as defined in claim 29 wherein said support rods are formed from stainless steel and said tubular support members are formed from opaque quartz to prevent said support rods and tubular support members from being electrically energized as a result of contact with said coiled resistance heater.

31. A high efficiency, non-contaminating fluid heater for heating an ultra pure fluid with a minimum amount of contamination as the ultra pure fluid passes through the fluid heater comprising first and second tubular members formed from an electrically nonconductive, substantially inert material, each of said tubular members having a generally helical configuration and including an outer surface and a helical passageway through which the ultra pure fluid flows, each of said first and second tubular members having a longitudinal axis with said longitudinal axes being substantially coaxial, said helical passageway in said first tubular member being in fluid communication with said helical passageway in said second tubular member and providing for the sequential flow of fluid between said helical passageways and said first and second members, said second tubular member substantially surrounding said first tubular member, a resistance heater disposed in intimate contact with said outer surface of said first tubular member for heating the ultra pure fluid which flows through said helical passageway in said first tubular member by radiation, conduction and convection, said ultra pure fluid flowing through said second tubular member absorbing radiated and convective heat from said resistance heater to increase the efficiency of said fluid heater and a housing formed from an infrared reflective material substantially surrounding said first and second tubular members to reduce the radiated heat flow from said resistance heater to the ambient environment to increase the efficiency of the fluid heater and wherein said first tubular member at least in part supports said second tubular member, said longitudinal axes of said first and second tubular members are substantially coaxial and horizontally disposed, and further including elongate support means extending in a substantially horizontal direction for supporting said first tubular member to prevent sagging thereof when said resistance heater is energized, said elongate support means including a plurality of support rods and a plurality of tubular support members, each of said support rods being located in one of said tubular support members, said tubular support members being formed, at least in part, from an electrically insulating material which is substantially inert, said support rods and tubular support members supporting said first tubular member to prevent sagging thereof.

32. A high efficiency, non-contaminating fluid heater as defined in claim 31 wherein said support rods are formed from stainless steel and said tubular support members are formed from quartz to prevent said support rods and tubular support members from being electrically energized as a result of engagement with said resistance heater.

* * * * *